US006119384A

United States Patent [19]

Fischer

[11] Patent Number: 6,119,384

[45] Date of Patent: Sep. 19, 2000

[54] DISPLAY SIGN ASSEMBLY

[75] Inventor: Terry D. Fischer, Harvey, N. Dak.

[73] Assignee: KRK Development, Inc., Devils Lake, N. Dak.

[21] Appl. No.: 08/574,159

[22] Filed: Dec. 18, 1995

[51] Int. Cl.[7] ..... G09F 7/08

[52] U.S. Cl. ..... 40/606; 40/590; 40/657; 40/618

[58] Field of Search ..... 40/590, 606, 611, 40/618, 649, 657, 578, 718

[56] References Cited

U.S. PATENT DOCUMENTS

| | | | |
|---|---|---|---|
| 3,702,033 | 11/1972 | Coleman | 40/591 |
| 4,035,940 | 7/1977 | Michey et al. | 40/590 X |
| 4,183,160 | 1/1980 | Brodersen | 40/718 |
| 4,607,444 | 8/1986 | Foster | 40/591 X |

*Primary Examiner*—Cassandra H. Davis
*Attorney, Agent, or Firm*—David A. Lingbeck

[57] ABSTRACT

The display sign assembly comprises a trailer having a flatbed thereon, sign frame supports mounted upon the flatbed, a sign frame formed into a quadrilateral configuration and having a plurality of channel members each having a U-shaped cross-section with the open sides of the channel members directed inwardly of the quadrilateral configuration, and a wall having edges which are received in the open sides of the channel members and which are sealed to the channel members so that moisture cannot seep between the wall and the channel members. The sign frame also includes a pair of reinforcement channel members fixedly attached back-to-back to one another and traversing through the quadrilateral configuration and attached to at least two of the other channel members which form the quadrilateral configuration to stabilize the wall and essentially prevent the wall from wobbling back and forth as the trailer is moved upon a road.

3 Claims, 5 Drawing Sheets

DISPLAY SIGN ASSEMBLY

BACKGROUND OF THE INVENTION

The present invention relates to a display sign assembly which can be pulled behind a prime mover and can be moved up and down a road quite easily without the display sign or the lettering and numerals on the sign becoming damaged by the forces of the wind. The display sign assembly can be moved to any location and parked without any special attention being given to the display sign assembly.

There are many different types or styles or ways of displaying a message for the general public to see, in particular. There are billboards galore across the world, which are mounted upon stationary supports usually alongside a major thoroughfare with the billboards displaying advertisements and other messages. Then there are also signs which have flashing lights to draw attention to the signs and to the establishments they describe, these signs being fixed in position usually either on the business establishments or at least next to them. Of course, there are signs which are removably mounted to vehicles such as buses, which display advertisements or other types of messages. In all these cases, none of the signs known in the art stand alone and can be moved up and down a road without the wind doing a lot of damage to the sign.

SUMMARY OF THE INVENTION

This invention refers to a display sign assembly which can be towed behind a prime mover at road speed without the display sign becoming damaged in any way, and which comprises a trailer having a flatbed on top thereof and a removable tongue, a pair of sign frame support means fastened upon the ends of the trailer, a sign frame comprising preferably channel members, a wall having a top section and a bottom section and two sides upon which to display messages, a plurality of flexible tracks fixedly arranged in rows upon both sides of the wall, a plurality of silk screened and fluorescent figures such as letters, numbers, and symbols which can be removably disposed upon the tracks and arranged according to the desires of the user, and a plurality of stabilizing means two of which are attached to a respective one of the sign frame support means and each of which comprises a sleeve and a leg member fastenably slidable in the sleeve and engageable with the ground to stabilize the display sign assembly.

One objective of the present invention is to provide a display sign assembly which can be moved up and down a road at essentially road speed without it becoming damaged from the wind or without it losing any of the figures thereon.

Another objective of the present invention is to provide a display sign assembly which can be easily and conveniently moved to any location for easy setup.

Also, another objective of the present invention is to provide a display sign assembly which has a double reinforcement means to prevent the wall from blowing apart during the moving thereof.

Further, another objective of the present invention is to provide a display sign assembly which will last longer than any other sign because the wall is coated with a protectorant and the ends of the wall are sealed to prevent moisture from seeping in the cracks of the wall and causing the wall to rotten.

Yet, another objective of the present invention is to provide a display sign assembly which has stabilizers to secure the sign much like that of a stationary sign.

Further objectives and advantages of the present invention will become apparent as the description proceeds and when taken in conjunction with the accompanying drawings wherein:

DETAILED DESCRIPTION OF THE INVENTION

Figure 1:
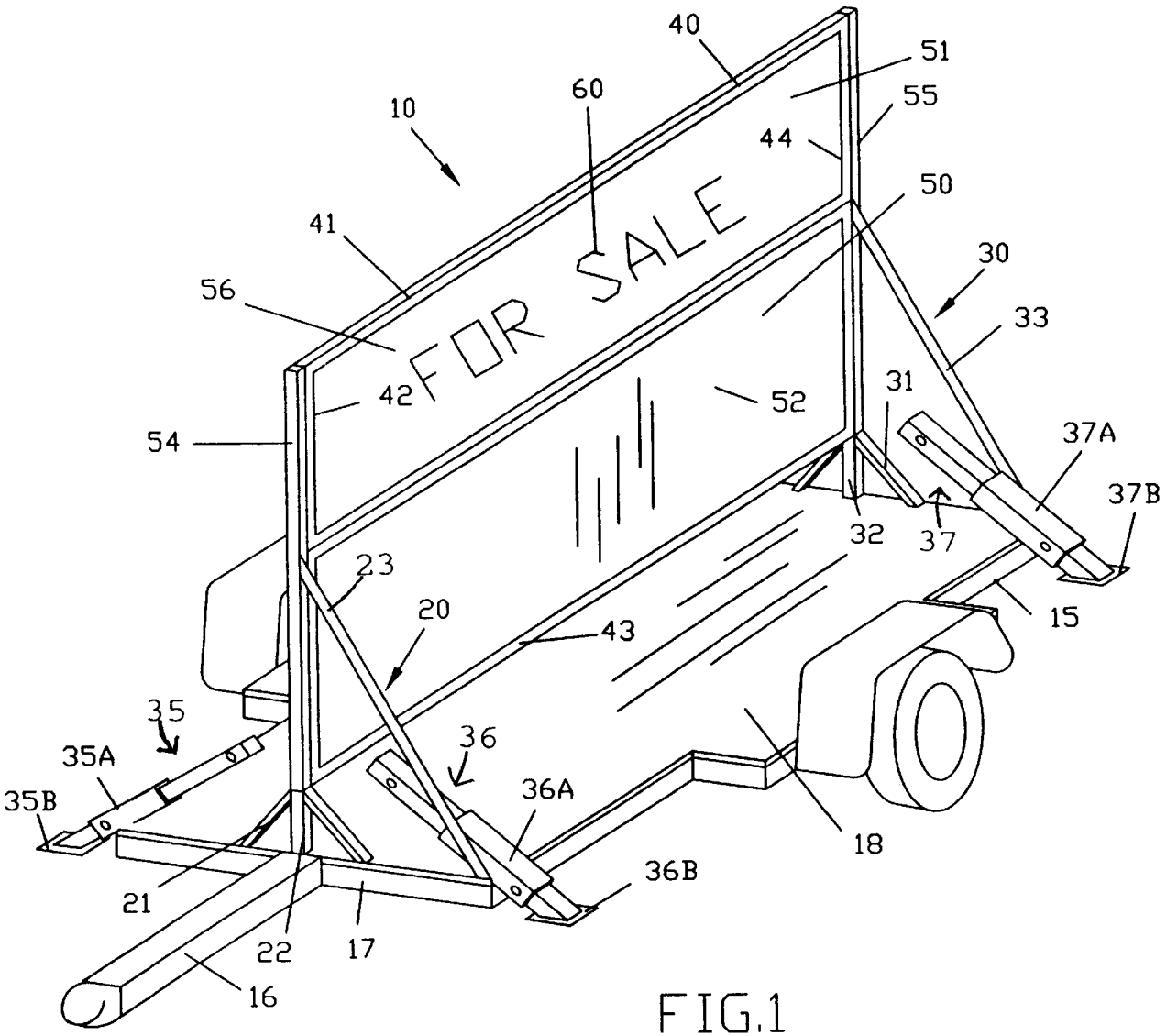
FIG. 1 is a forward perspective view of the display sign assembly.

Referring to the drawings in FIGS. 1–5, in particular, the display sign assembly 10 comprises a trailer 15 having a tongue 16 removably attached to the frame 17 thereof with a pair of pins (not shown) which are insertable in portions of the frame 17 and through the tongue 16 and further having a flatbed 18 fastened to the top of the frame 17 of the trailer and upon which a user can walk, stand and perform work. The tongue 16 can be easily and conveniently removed from the trailer 15 and placed out of the way when the display sign is set up at a particular location so that passersbys do not stumble over the tongue 16 and injure themselves.

The display sign assembly 10 also comprises a pair of sign frame supports 20,30, one securely fastened with U-bolts to the front end of the trailer 15 and the other securely fastened with U-bolts to the rear end of the trailer 15. Each of the sign frame supports 20,30 comprises a base member 21,31 resting upon the flatbed 18 and fastened to the trailer 15 and further including a sign frame mount 22,32 such as a short post which is fixedly attached to the base member 21,31 and extends upward therefrom and which is fixedly secured with braces to the base member 21,31, and further comprises an elongate brace member 23,33 attached to one end of the trailer 15. Each of the sign frame supports 20,30 also comprise stabilizing means 35–38 having a pair of sleeves 35A–38A each being fixedly attached to the frame of the trailer 15 and a pair of leg members 35B—35B each being fastenably slidable in a respective one of the sleeves 35A–38A and engageable with the ground for stabilizing the trailer 15 and the wall 50 while the display sign assembly 10 is in a stationary position. The leg members 35B–38B are fastenable to the sleeves 35A–38A with conventional threaded members (not shown) which are threadable through the walls of the sleeves 35A–38A and engageable with the leg members 35B–38B. To move the trailer 15, the user unthreads the threaded members from engagement with the leg members 35B–38B and slides the leg members 35B–38B upward through the sleeves 35A–38A and out of engagement with the ground and rethreads the threaded members through the sleeves 35A—35A and into engagement with the leg members 35B–38B to hold the leg members **35*b*–38*b* so that they don't slide back down into engagement with the ground. When the display sign assembly 10 is set up at a particular location, the user again unthreads the threaded members and slides the leg members 35B–38B** downward into engagement with the ground.

Figure 2:
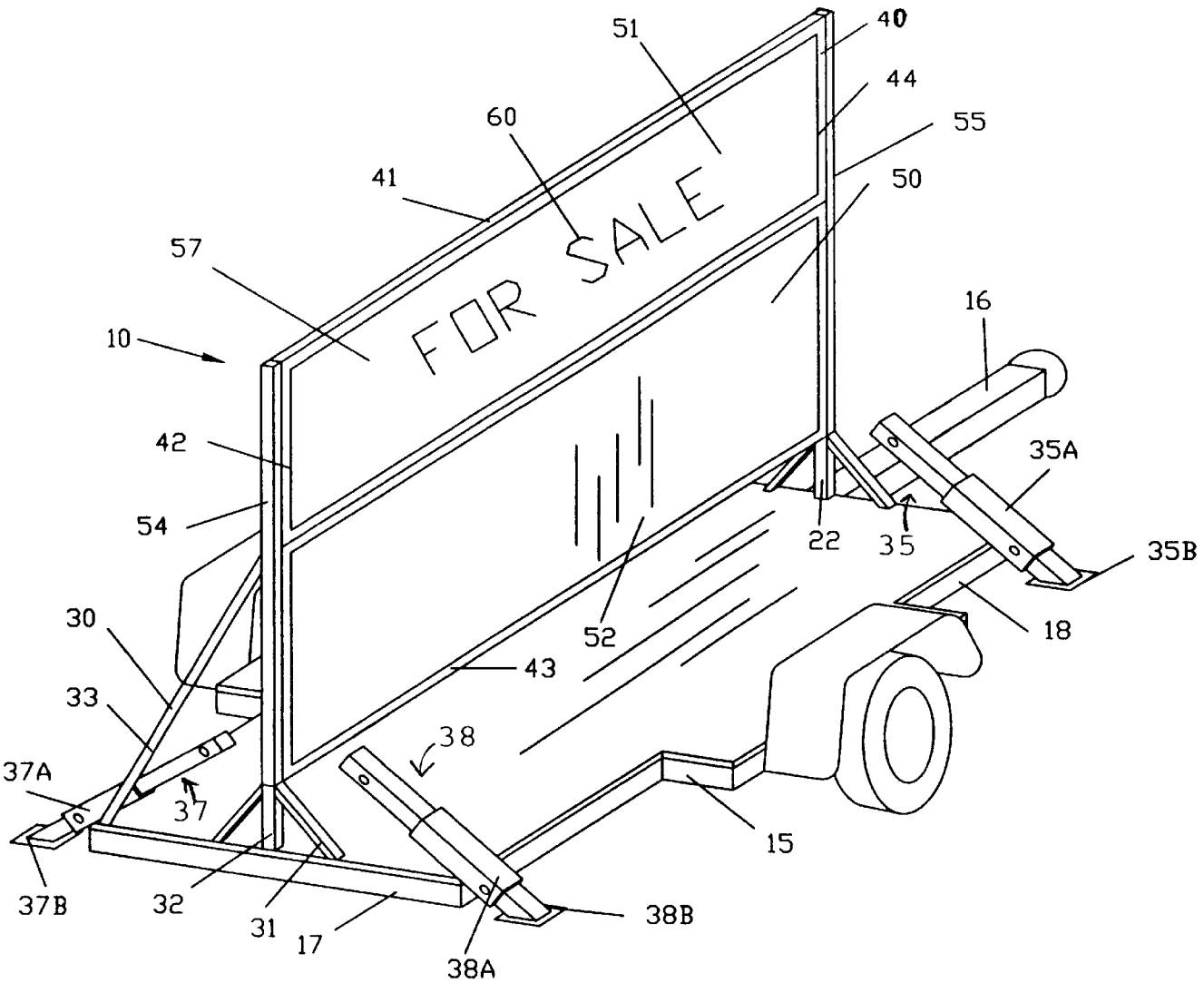
FIG. 2 is a rearward perspective view of the display sign assembly.
Figure 3:
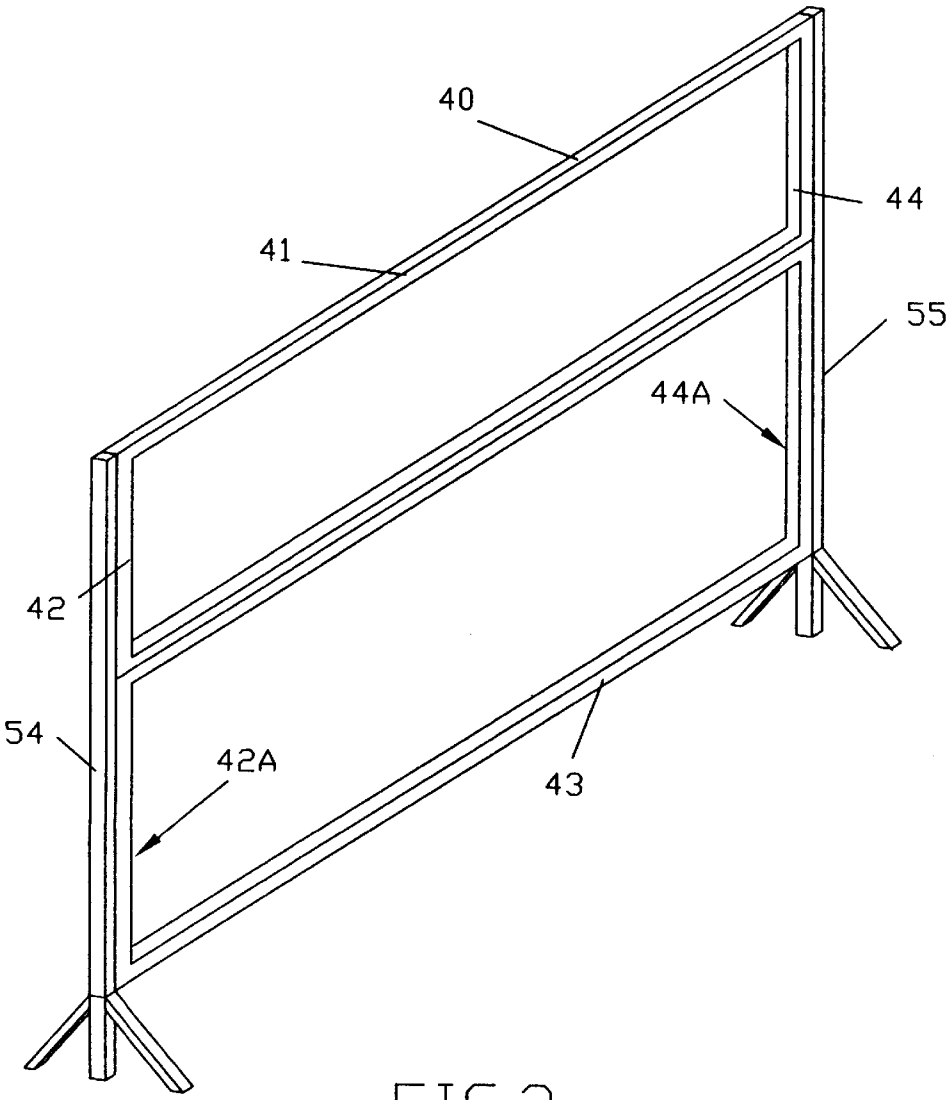
FIG. 3 is a perspective view of the sign frame of the display sign assembly.
Figure 4:
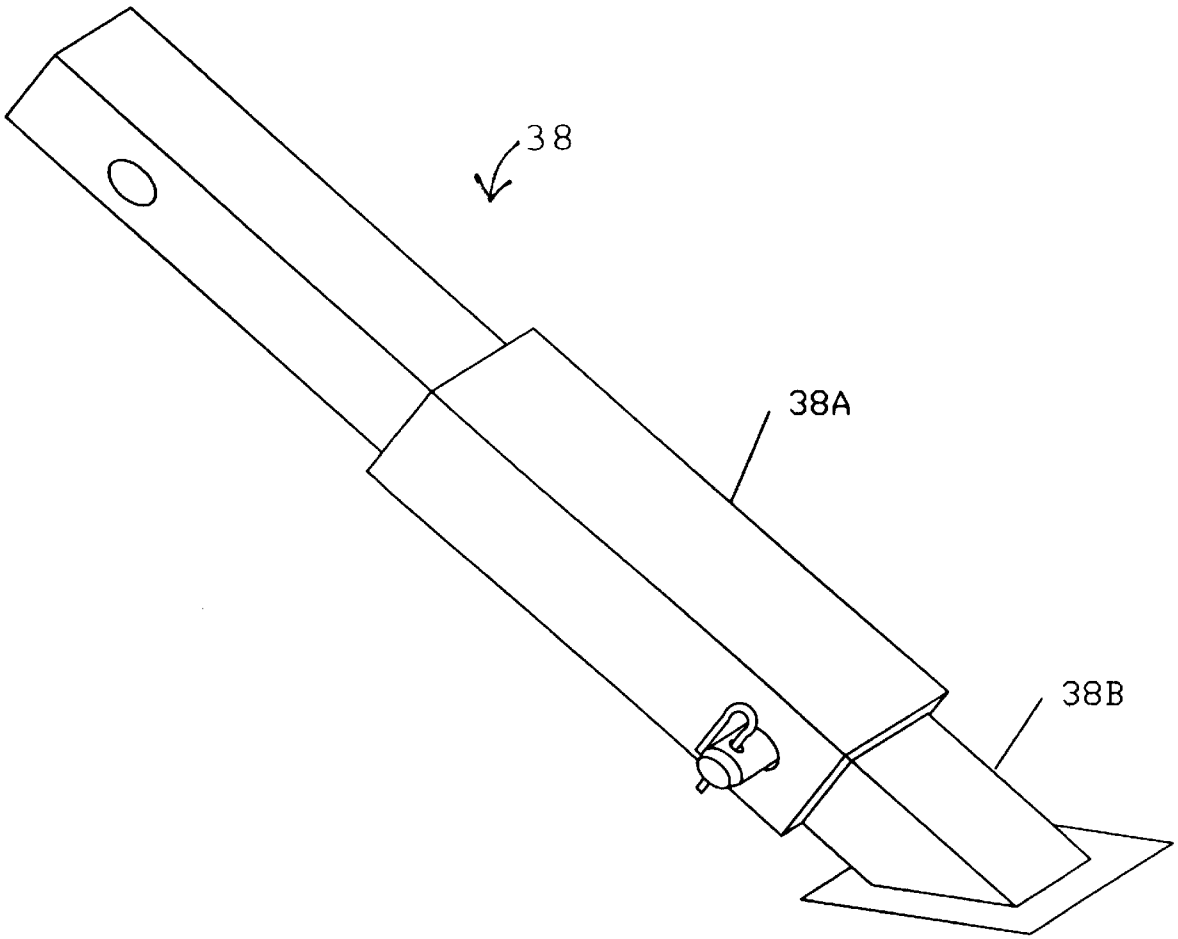
FIG. 4 is a detailed perspective view of one of the stabilizer means of the display sign assembly.
Figure 5:
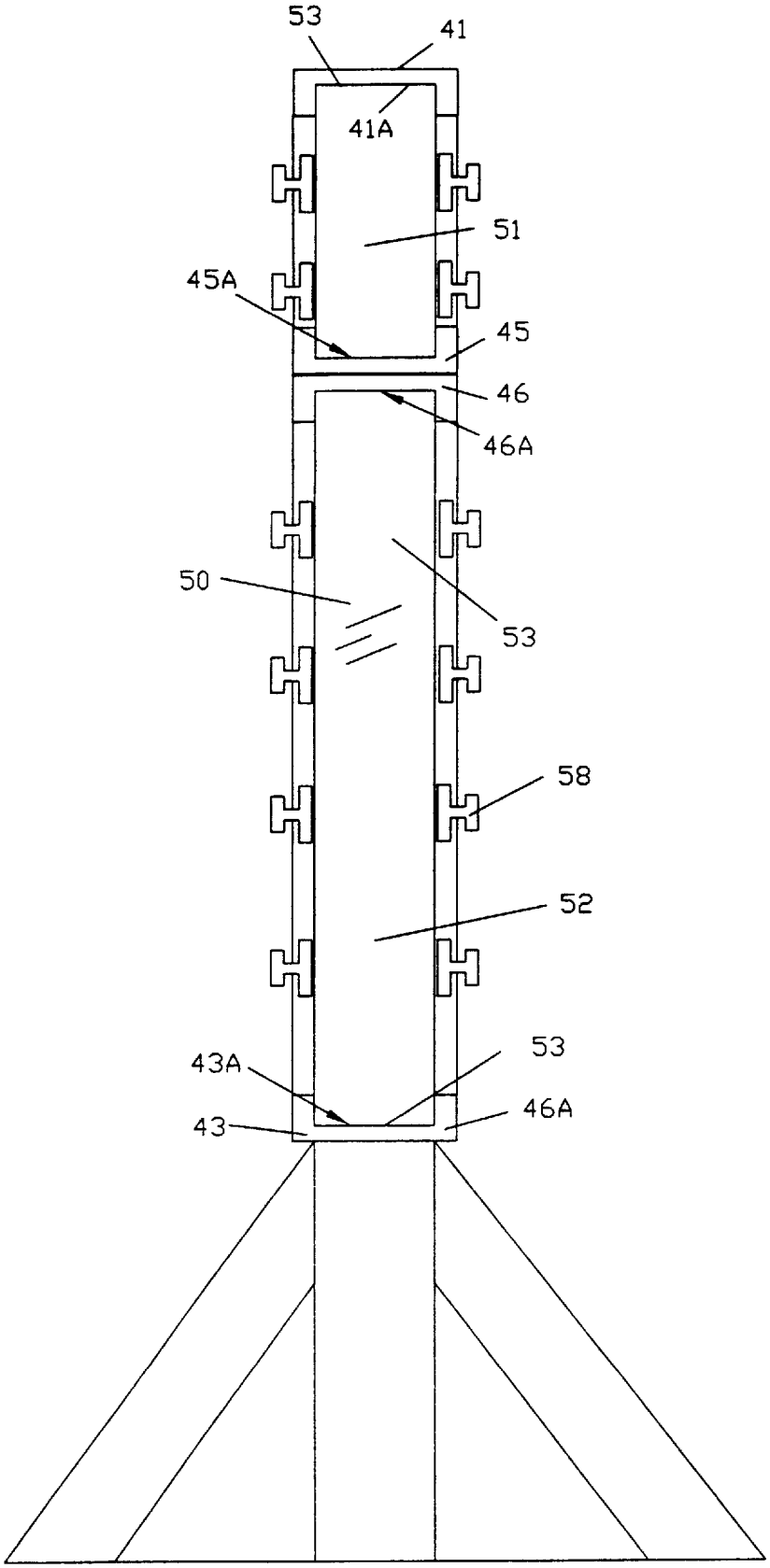
FIG. 5 is a cross section view of the wall showing, in particular, the wall sealed in the channel members and the tracks mounted upon the wall.

As shown in FIGS. 1–3, the display sign assembly 10 also comprises a sign frame 40 comprising a plurality of perimeter channel members 41–44 fixedly attached end-to-end and each having a U-shaped cross-section and being arranged in essentially a quadrilateral configuration with the right portion 41A–44A of the perimeter channel members 41–44 directed inwardly of the quadrilateral configuration. The sign frame 40 also includes a reinforcement means comprising a pair of reinforcement channel members 45 & 46 having a U-shaped cross-section and which are fixedly attached or welded back-to-back to each other with the top reinforcement channel member 45 having its open side 45A directed upward and the bottom reinforcement channel member 46 having its open side 46A directed downward. The reinforcement members centrally and horizontally traverses and intersects the quadrilateral configuration and interconnects the side perimeter channel members 41 & 43 to stabilize and strengthen the sign frame 40 especially when the trailer 15 is moved on roads. One end of the reinforcement means is fixedly attached to one side perimeter channel member 41 and the other end is fixedly attached to the opposed side perimeter channel member 43 to strengthen and stabilize the sign frame 40 so that it won't wobble and come apart due to the wind as it is moved upon the road. Angle iron used as a substitute for the channel members do not provide the strength and stability to the sign frame as do the channel members with the result being that the wind tends to break apart the sign frame when the trailer is moved on the road.

A wall 50 having a top section 51 and a bottom section 52 is sealingly mounted to the sign frame 40 with the edges 53 of the wall 50 engageably received in the channel members 41–46 which are sealingly engaged to the edges 53 of the wall 50 so that moisture cannot seep in between the channel members 41–46 and the wall 50 and eventually rot out the wall 50 itself. A pair of elongate members 54 & 55 are fixedly attached to the side perimeter channel members 41 & 43, one to each channel member. Both of the elongate members 54 & 55 have openings in the bottoms thereof, the openings being dimensioned to engageably receive the sign frame mounts 22 & 32 which slide into the elongate members 54 & 55 to secure the sign frame 40 and the wall 50 upon the trailer 15. The brace members 23 & 33 which are attached to the ends of the trailer 15 are also attached to a middle portion of the elongate members 54 & 55 to secure the sign frame 40 and the wall 50 which has two sides 56 & 57 upon which to display messages. The sides 56 & 57 face essentially to the sides of the trailer with the edges 53 of the wall 50 being essentially parallel to the movement of the trailer 15.

A plurality of flexible tracks 58 preferably made of vinyl are fixedly attached to and arranged in rows on the sides 56 & 57 of the wall 50. The tracks above and below one another are spaced from each other such that figures 60 such as letters, numbers, and symbols which have a top edge (not shown) and a bottom edge (not shown), slide in the tracks 58 with the top edge of a particular figure sliding in the track above the figure and the bottom edge sliding on the track below the figure. The figures 60 are all silk-screened and coated with a fluorescent material so that they can be seen quite well in the dark. The user of the display sign assembly 10 can easily create readable messages on the sides of the wall by conveniently arranging the figures in the tracks and upon the wall. Furthermore, if the user wants to display a message while the trailer is moving, the user can simply fasten the figures to the sides of the wall with screws which will prevent the figures from being blown off the wall by the wind. The display sign assembly can be used to display messages not only when it is standing still but also when it is being moved.

Various changes and departures may be made to the invention without departing from the spirit and scope thereof. Accordingly, it is not intended that the invention be limited to that specifically described in the specification or as illustrated in the drawings but only as set forth in the claims.

What is claimed is:

1. A display sign assembly comprising:

a wall having two sides, a top portion and a bottom portion and a plurality of tracks fixedly attached to said sides;

a plurality of figures arrangeable upon and between said tracks;

a sign frame comprising a plurality of channel members, said channel members being attached about the edges of said wall and including a plurality of perimeter channel members fixedly attached end-to-end; and sign frame support means which is capable of being mounted upon a trailer having a flatbed thereupon, said sign frame support means comprising a pair of elongate members attached to said sign frame; base members; sign frame mounts being fixedly attached to said base members and engaged to said elongate members, and a plurality of stabilizing means.

2. A display sign assembly comprising:

a wall having two sides and a plurality of tracks fixedly attached to said sides;

a sign frame comprising a plurality of channel members being attached about the edges of said wall and including a plurality of perimeter channel members; and sign frame support means which is capable of being mounted upon a trailer, said sign frame support means comprising a pair of elongate members attached to said sign frame, and further comprising base members, at least two brace members attached to said elongate members and capable of being attached to said trailer to provide strength and stability to said wall and said sign frame, and a plurality of stabilizing means, said elongate members being fixedly attached to at least one of said perimeter channel members and being removably mounted to said base members.

3. A display sign assembly as described in claim 2, wherein said stabilizing means comprises a plurality of sleeves each of which is capable of being fixedly attached to said trailer and comprises a plurality of leg members each being fastenably slidable in a respective one of said sleeves for stabilizing said wheeled displayed sign.

* * * * *